United States Patent [19]

Lewis

[11] 4,044,734

[45] Aug. 30, 1977

[54] EXHAUST GAS RECIRCULATION VALVE MALFUNCTION INDICATOR APPARATUS

[75] Inventor: John A. Lewis, Detroit, Mich.

[73] Assignee: Ford Motor Company, Dearborn, Mich.

[21] Appl. No.: 691,263

[22] Filed: May 28, 1976

[51] Int. Cl.[2] ..... F02M 25/06

[52] U.S. Cl. ..... 123/119 A; 340/136

[58] Field of Search ..... 123/119 A; 340/136, 340/220, 239

[56] References Cited

U.S. PATENT DOCUMENTS

| | | | |
|---|---|---|---|
| 3,779,222 | 12/1973 | Lorenz | 123/119 A |
| 3,794,006 | 2/1974 | Woodward | 123/119 A |
| 3,924,587 | 12/1975 | Murphy | 123/119 A |
| 3,937,194 | 2/1976 | Tamaki et al. | 123/119 A |

*Primary Examiner*—Wendell E. Burns

*Attorney, Agent, or Firm*—Robert E. McCollum; Keith L. Zerschling

[57] ABSTRACT

An internal combustion engine provided with an exhaust gas recirculating (EGR) system containing a vacuum/electric switch assembly activated in response to a non-movement type malfunction of the EGR valve to energize a warning light.

5 Claims, 2 Drawing Figures

EXHAUST GAS RECIRCULATION VALVE MALFUNCTION INDICATOR APPARATUS

This invention relates in general to an exhaust gas recirculating (EGR) system for an internal combustion engine. More particularly, it relates to a vacuum/electric switch apparatus for monitoring the operation of the EGR valve.

EGR valve assemblies are used to recirculate exhaust gas back into the engine to reduce the production of NOx and thereby reduce output of objectionable emissions into the atmosphere. It is desirable, therefore, that some means be provided for monitoring the EGR valve movement, i.e., sensing EGR valve malfunction. EGR valve malfunction indicators are known, for example, as shown in U.S. Pat. No. 3,779,222, Lorenz, Malfunction Indicator For Exhaust Gas Recirculation Valve; U.S. Pat. No. 3,850,151, Mawatari et al, Failure Warning Device For Exhaust Gas Recirculation System; and U.S. Pat. No. 3,859,619 Ishihara et al, Valve Operation Detecting Device. Each of the latter prior art devices provides either an electrical or capillary tube control connected to a function indicator. However, none provide a simple apparatus to actuate a malfunction indicator and one that is responsive to nonmovement of the EGR valve even though sufficient vacuum force is present to move the valve were it normally operative.

It is, therefore, a primary object of this invention to provide a simple mechanical apparatus for detecting a malfunction of the EGR valve due to nonmovement of the valve even though the normal vacuum actuating force is present.

It is another object of the invention to provide an EGR valve malfunction indicator that is simple in construction and economical to manufacture.

Figure 1:
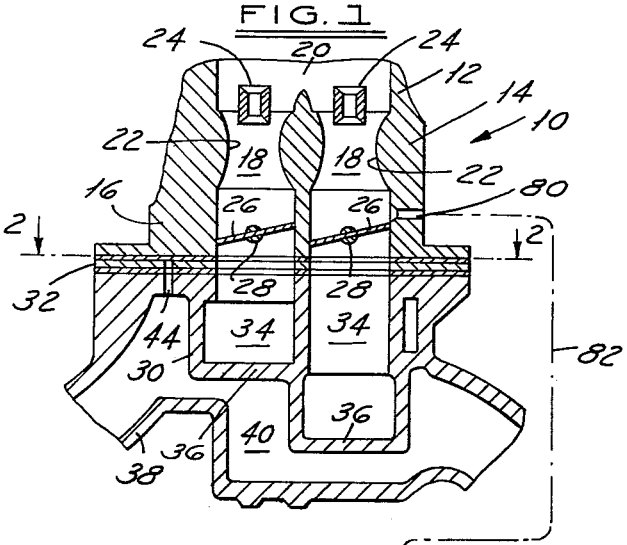
Figure 2:
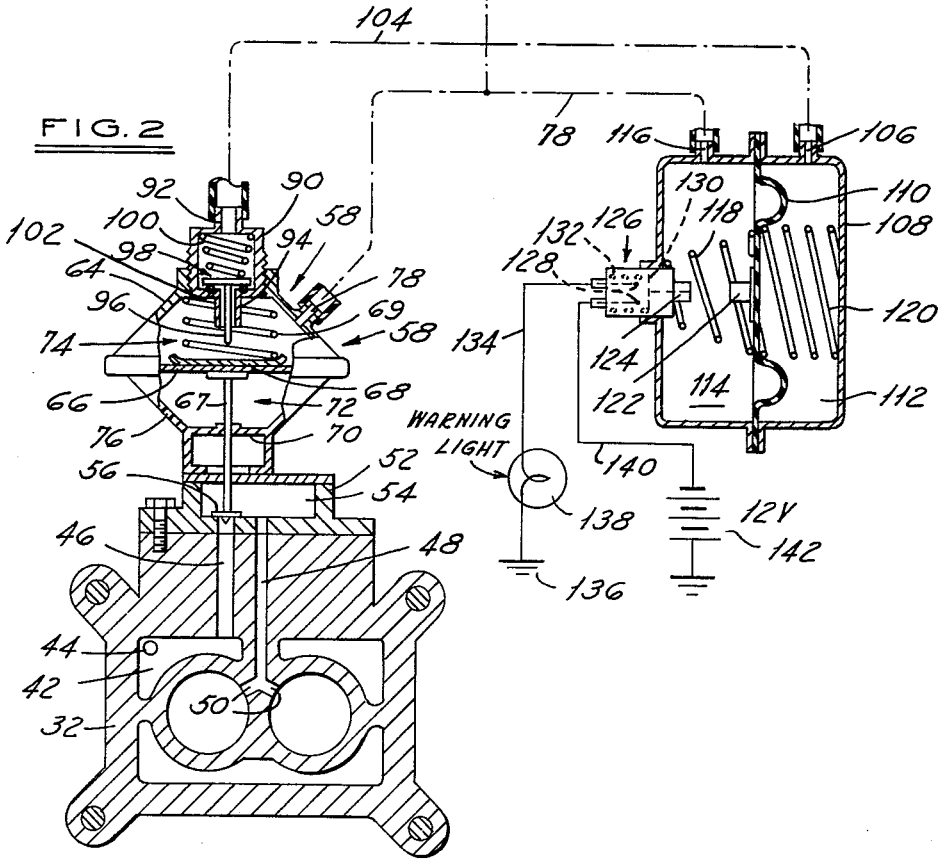

Other objects, features and advantages of the invention will become more apparent upon reference to the succeeding, detailed description thereof, and to the drawings illustrating the preferred embodiment thereof; wherein, FIG. 1 is a cross-sectional view of a portion of a carburetor embodying the invention; and, FIG. 2 is a cross-sectional view taken on a plane indicated by and viewed in the direction of the arrows 2—2 of FIG. 1.

FIG. 1 illustrates a portion 10 of one-half of a four-barrel carburetor of a known downdraft type. It has an air horn section 12, a main body portion 14, and a throttle body 16, joined by suitable means not shown. The carburetor has the usual air/fuel induction passages 18 open at upper ends 20 to fresh air from the conventional air cleaner, not shown. The passages 18 have the usual fixed area venturis 22 cooperating with boost venturis 24 through which the main supply of fuel is inducted, by means not shown.

Flow of air and fuel through induction passages 18 is controlled by a pair of throttle valve plates 26 each fixed on a shaft 28 rotatably mounted in the side walls of the carburetor body.

The throttle body 16 is flanged as indicated for bolting to the top of the engine intake manifold 30, with a spacer element 32 located between. Manifold 30 has a number of vertical risers or bores 34 that are aligned for cooperation with the discharge end of the carburetor induction passages 18. The risers 34 extend at right angles at their lower ends 36 for passage of the mixture out of the plane of the FIG. to the intake valves of the engine.

The exhaust manifolding part of the engine cylinder head is indicated partially at 38, and includes an exhaust gas crossover passage 40. The latter passes from the exhaust manifold, not shown, on one side of the engine to the opposite side beneath the manifold trunks 36 to provide the usual "hot spot" beneath the carburetor to better vaporize the air/fuel mixture.

As best seen in FIG. 2, the spacer 32 is provided with a worm-like recess 42 that is connected directly to crossover passage 40 by a bore 44. Also connected to passage 42 is a passage 46 alternately blocked or connected to a central bore or passage 48 communicating with the risers 34 through a pair of ports 50. Mounted to one side of the spacer is a cup shaped boss 52 forming a chamber 54 through which passages 46 and 48 are interconnected.

As is known, it is necessary and desirable to provide some sort of control to prevent the recirculation of exhaust gases at undesirable times. For this purpose, passage 46 normally is closed by an EGR valve 56 that is moved to an open position by a servo 58. The servo includes a hollow outer shell 64 containing an annular flexible diaphragm 66. The stem 67 of valve 56 is fixed to a pair of retainers 68 that are secured to diaphragm 66 and serve as a seat for a compression spring 69 normally biasing the valve to its closed position. The stem slidably and sealingly projects through a plate 70 closing chamber 54. The diaphragm 66 divides the interior into an air chamber 72 and a signal vacuum chamber 74. Chamber 72 is connected to atmospheric pressure through a vent 76, while chamber 74 is connected to a vacuum signal force through a line 78.

As shown in FIG. 1, the carburetor passage 18 contains an exhaust gas recirculating (EGR) port 80 that is connected by a line 82 to vacuum line 78. The port 80 is located just above the edge of the throttle valve 26 in its closed position so as to be traversed by the edge as it moves towards an open throttle position. Therefore, when the throttle valve is closed, the port 80 will be essentially at atmospheric pressure or at the pressure in the air inlet 20. As throttle valve 26 moves open, port 80 will be subjected progressively to an increasing vacuum force until the full value of manifold vacuum is reached once the throttle valve edge has passed the upper edge of port 80.

In operation as thus far described, with the parts in the position shown at closed throttle, the force of spring 69 will maintain EGR valve 56 closed and no recirculation of exhaust gases will occur from passage 46 to passage 48. As throttle valve 26 is opened, progressively increasing vacuum forces will be transmitted to line 78 and vacuum chamber 74 until the force of spring 69 is overcome and the diaphragm 66 and valve 56 moved upwardly to connect passages 46 and 48.

Turning now to the invention, as stated previously, it is desirable to provide an apparatus for indicating a malfunction of the EGR valve, and particularly a nonmovement of the valve caused by stickiness or inoperativeness of the valve per se rather than lack of an actuating force. More specifically, FIG. 2 shows the upper or cover portion of servo shell 64 formed with a screw adapter. The latter threadedly receives therein a vacuum plunger housing 90 provided with nipples 92 and 94 at opposite ends. The lower nipple 94 acts as a guide for the finger or plunger actuator portion 96 of a movable, flat, disc valve 98. The latter is biased by a spring 100 against an annular rubber seal 102 to normally prevent communication between vacuum chamber 74 and the upper nipple 92.

The finger actuator portion 96 extends downwardly to a point adjacent the diaphragm spacer 68 so as to be contacted by the same during upward movement of the spacer and diaphragm when actuated by a vacuum force in chamber 74 sufficient to overcome the force of spring 69. In so doing, upward movement of actuating finger portion 96 will raise valve 98 off rubber seal 102 and permit communication of the vacuum in chamber 74 to nipple 92. It will be clear, of course, that the point of extension of portion 96 will be adjusted to some point beyond the EGR valve start-to-open point so as not to be opened in response to minor fluctuations of diaphragm 66 due to fluctuations in the vacuum actuating force.

The upper nipple 92 in this case receives a flexible vacuum hose or line 104 connected to an inlet 106 of a second servo housing 108. The latter servo constitutes a vacuum/electric switch assembly. The housing 108 contains an edge mounted annular flexible diaphragm 110 dividing the housing into two vacuum chambers 112 and 114. Chamber 114 is connected by a second inlet 116 to EGR vacuum line 78. A pair of centering springs, calibration spring 118 and, if desired, a light spring 120 are provided in chambers 112 and 114 to bias the diaphragm 110 to the neutral position shown.

Diaphragm 110 contains an actuator 122 that upon leftward movement engages the movable plunger 124 of a plunger type electrical contact switch 126. The latter may be of a known construction consisting of a pair of electrical contacts 128 adapted to be bridged by the base contact member 30 of a movable plunger 124. The latter is normally biased by a spring 132 to the unbridged position shown. One of the contacts 128 is connected by a line 134 to a ground connection 136 past a malfunction indicating warning light 138. The opposite one of contacts 128 is connected by a line 140 to any suitable power source, which in this case is indicated as a grounded 12 volt automotive type battery 142.

In operation, with the parts positioned as shown in the engine off or idle condition, no vacuum is transmitted through line 82 to vacuum chambers 74 or 114. Accordingly, chambers 74, 114 and 68 will be at atmospheric pressure and spring 69 will maintain diaphragm 66 in the position shown out of contact with the finger actuating portion 96. Valve 98 will be closed. With chamber 114 at atmospheric pressure, spring 118 will maintain the two engaging portions 122 and 124 out of engagement. Switch 126, therefore, will not be activated.

As soon as throttle plate 26 is moved to an open position, vacuum in line 82 is communicated to chamber 74 and chamber 114. The force of spring 118 will be chosen to be essentially the same as the force of spring 69 so that switch 126 will not be actuated prior to the force acting on diaphragm 56 being sufficient to overcome the force of spring 69. Assuming now that the EGR valve diaphragm 66 moves upwardly under the force of the vacuum in chamber 74, the actuating finger portion 96 will be engaged and moved upwardly to unseat valve 98. This will allow the vacuum in chamber 74 to be communicated by line 104 to the second servo chamber 112, thereby equalizing the vacuum on opposite sides of diaphragm 110. Accordingly, diaphragm 110 will remain in the position shown and the malfunction indicating switch 126 will remain unactuated. As the throttle valve moves towards a closed position, the decreasing vacuum in chamber 74 will permit the spring 69 to slowly return diaphragm 66 towards the closed valve position shown. This will also slowly bleed the vacuum from chamber 112 as plunger 96 moves downwardly to seat valve 98.

Assume now that the EGR valve 56 is unable to move for one reason or another even though sufficient vacuum in chamber 74 is present to overcome the force fo spring 69. The resulting non-movement of diaphragm 66, therefore, fails to move the finger actuating portion 96 and valve 98 will remain seated by spring 100. This results in no vacuum being transmitted through line 104 to second servo chamber 112. With vacuum in chamber 114, diaphragm 110 is moved leftwardly to engage the actuating portion 122 with the plunger 124 to move it leftwardly to bridge the contacts 128. This will connect the circuit from the battery 142 to the malfunction indicating warning light 138 to thereby indicate a malfunction of the EGR valve 56. The non-flow of exhaust gases is thereby indicated.

While the invention has been shown and described in its preferred embodiment, it will be clear to those skilled in the arts to which it pertains that many changes and modifications may be made thereto without departing from the scope of the invention.

I claim:

1. A malfunction indicating apparatus for an engine exhaust gas recirculating (EGR) system that includes a vacuum controlled first servo connected to an (EGR) valve that is spring biased to a position blocking the flow of engine exhaust gases to the engine intake manifold and moved by vacuum above a predetermined level applied to the servo to a position permitting the flow, the apparatus including a pressure balanced second servo means operably connected to the first servo and attaining a pressure unbalance condition to actuate a malfunction indicator in response to non-movement of the (EGR) valve upon application of vacuum above the predetermined level to the first servo, a source of carburetor induction passage throttle valve controlled vacuum, the pressure balancing servo means including a hollow housing divided into first and second chambers by a piston, means connecting the source of vacuum to the first servo and to the first chamber, second means connecting the first servo to the second chamber whereby flow of vacuum to the first servo flows vacuum to both first and second chambers to provide a pressure balanced neutral position of the piston, spring means acting on opposite sides of the piston to urge the piston to the balanced neutral position, malfunction indicator means engaged by and rendered operative in response to movement of the piston in one direction to a predetermined position, and control means in the second means normally blocking vacuum to the second chamber to thereby effect movement of the piston by the vacuum in the first chamber to engage the malfunction indicator means.

2. A malfunction indicating apparatus for an engine exhaust gas recirculating (EGR) system that includes a vacuum controlled first servo connected to an (EGR) valve that is spring biased to a position blocking the flow of engine exhaust gases to the engine intake manifold and moved by vacuum above a predetermined level applied to the servo to a position permitting the flow, the apparatus including a pressure balanced second servo means operably connected to the first servo and attaining a pressure unbalance condition to actuate a malfunction indicator in response to non-movement of the (EGR) valve upon application of vacuum above the predetermined level to the first servo, the first servo including a piston connected to the valve, spring means biasing the piston and valve to a valve closed position, the servo having a vacuum chamber and first normally closed conduit means and second normally open conduit means connected respectively from the chamber to opposite sides of the pressure balancing means, and control means operable in response to movement of the piston to open the first conduit means to direct vacuum to opposite sides of the pressure balancing means.

3. An apparatus as in claim 2, the pressure balancing means comprising a second servo having a housing and a second piston dividing the housing into first and second chambers connected respectively to the first and second conduit means, spring means on opposite sides of the second piston biasing the second piston to a neutral position, and malfunction indicator means engaged by the second piston upon movement of the second piston in response to application of vacuum to the second chamber concurrent with the blocking of vacuum to the first chamber.

4. An apparatus as in claim 2, the control means comprising a second valve in the first conduit means spring movable to block the first conduit means and having a portion projecting to a location adjacent the piston to be engaged thereby upon movement of the piston to be moved therewith to a position wherein the valve unblocks the first conduit means.

5. An apparatus as in claim 3, the control means comprising a second valve movable in the first conduit means between a first position blocking communication of vacuum from the vacuum chamber to the first conduit means and a second position unblocking the communication, spring means biasing the second valve to the first position, the second valve having a finger actuating portion projecting to the first servo piston to be engaged by and moved by the first servo piston in response to application of vacuum above the predetermined level to the vacuum chamber whereby the second valve is moved to the second position to establish a pressure balance condition in the second servo and a movement of the second piston to a neutral position.

* * * * *